US012312048B1

(12) United States Patent
Page et al.

(10) Patent No.: US 12,312,048 B1
(45) Date of Patent: May 27, 2025

(54) DIVE DOORS FOR MARINE VESSELS HAVING LADDER STORAGE

(71) Applicant: Brunswick Corporation, Mettawa, IL (US)

(72) Inventors: Danielle N. Page, New Smyrna Beach, FL (US); Kristin M. McGinnis, Cocoa Beach, FL (US); David Courtemanche, Edgewater, FL (US)

(73) Assignee: Brunswick Corporation, Mettawa, IL (US)

( * ) Notice: Subject to any disclaimer, the term of this patent is extended or adjusted under 35 U.S.C. 154(b) by 588 days.

(21) Appl. No.: 17/835,591

(22) Filed: Jun. 8, 2022

(51) Int. Cl.
*B63B 29/20* (2006.01)
*B63B 27/14* (2006.01)

(52) U.S. Cl.
CPC ..... *B63B 29/20* (2013.01); *B63B 27/14* (2013.01); *B63B 2027/141* (2013.01)

(58) Field of Classification Search
CPC .... B63B 29/20; B63B 27/14; B63B 2027/141
See application file for complete search history.

(56) References Cited

U.S. PATENT DOCUMENTS

| | | | |
|---|---|---|---|
| 5,924,521 A | 7/1999 | Crockett | |
| 6,021,733 A | 2/2000 | Jaramillo, Sr. | |
| 6,938,573 B1 | 9/2005 | Garelick | |
| 7,182,175 B1 | 2/2007 | Schmitt et al. | |
| 8,356,568 B1 | 1/2013 | Chinn | |
| 9,120,540 B1 | 9/2015 | Foss et al. | |
| 9,708,039 B2 | 7/2017 | Neese | |
| 10,106,227 B2 | 10/2018 | Allender | |
| 10,220,920 B1 * | 3/2019 | Holseberg | B63B 19/08 |
| 10,501,151 B2 * | 12/2019 | Allender | B63B 17/04 |
| 11,186,346 B2 | 11/2021 | Overbye et al. | |
| 2010/0229781 A1 | 9/2010 | Garelick | |

FOREIGN PATENT DOCUMENTS

| | | |
|---|---|---|
| CN | 105599867 | 5/2016 |
| WO | 2020094957 | 5/2020 |

OTHER PUBLICATIONS

Declaration of Prior Art.

* cited by examiner

*Primary Examiner* — Anthony D Wiest
(74) *Attorney, Agent, or Firm* — Andrus Intellectual Property Law, LLP

(57) ABSTRACT

A marine vessel is for operating in a body of water. The marine vessel has a hull having a deck and a sidewall extending vertically upwardly relative to the deck, wherein together the sidewall and deck define an interior of the marine vessel. A dive door is pivotable about a vertical pivot axis into and between an open position opening a doorway through which a swimmer can exit the interior of the marine vessel and a closed position closing the doorway. A storage pocket is formed in an inside surface of the dive door facing the interior of the marine vessel. A retaining mechanism facilitates storage in and removal of a ladder from the storage pocket, the ladder being for enabling a swimmer to climb into or out of the body of water via the doorway when the dive door is in the open position.

20 Claims, 14 Drawing Sheets

DIVE DOORS FOR MARINE VESSELS HAVING LADDER STORAGE

FIELD

The present disclosure relates to marine vessels and to dive doors and ladders for marine vessels.

BACKGROUND

The following U.S. Patents are incorporated herein by reference in entirety.

U.S. Pat. No. 9,120,540 discloses a dive door for a marine vessel, the dive door having a planar body with an interior surface and an exterior surface. The door is disposed between the gunwale of the boat and is hingeably attached to the deck of the boat. The door is releasably retained to the gunwale by one or more latches disposed at a top edge of the dive door. One or more gas shocks are attached to the door and the boat so that the dive door is selectively operable between a deployed position and a closed position. When deployed, the interior surface of the dive door extends outwardly from the boat. In the closed position, the outer surface of the dive door matches the profile of the gunwale, providing a sleek integrated look. A ladder may be hinged to the dive door and is configured to extend downward into the water surface when the door is deployed.

U.S. Pat. No. 10,106,227 discloses a bulwark terrace with integrated door. The bulwark terrace is a portion of a bulwark on a ship or yacht which is hinged so as to be able to fold outwards and downwards and be flush with the deck after doing so, thereby extending the deck surface. The bulwark terrace also includes a door which may open independently of the bulwark terrace to allow boarding of the yacht or ship through the bulwark without deploying the bulwark terrace.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

In non-limiting examples disclosed herein, a marine vessel is for operating in a body of water. The marine vessel comprises a hull having a deck and a sidewall extending vertically upwardly relative to the deck, wherein together the sidewall and deck define an interior of the marine vessel. A dive door is pivotable about a vertical pivot axis into and between an open position opening a doorway through which a swimmer can exit the interior of the marine vessel and a closed position closing the doorway. A storage pocket is formed in an inside surface of the dive door facing the interior of the marine vessel. A retaining mechanism facilitates storage in and removal of a ladder from the storage pocket, the ladder being for enabling a swimmer to climb into or out of the body of water via the doorway when the dive door is in the open position.

In non-limiting examples the retaining mechanism includes a key and keyhole aperture, wherein the key and keyhole aperture are engageable to retain the ladder in the storage pocket and disengageable to facilitate removal of the ladder from the storage pocket. The keyhole aperture includes a wide end and a narrow end. The retaining mechanism is engageable by inserting the key into the wide end and lowering the key into the narrow end, and the retaining mechanism is disengageable by raising the key into the wide end and removing the key from the wide end.

In non-limiting examples, the retaining mechanism has a cleat which retains the ladder in the storage pocket. Optionally the cleat is pivotable into and between a closed position retaining the ladder in the storage pocket and an open position facilitating removal of the ladder from the storage pocket. A spring-loaded pin may be provided to retain the cleat in the closed position and alternately in the open position.

In non-limiting examples, the cleat extends over a lower end of the storage pocket such that a retaining tray is defined in the pocket between the cleat and the inside surface of the dive door.

In non-limiting examples, the retaining mechanism comprises a cover on the storage pocket, the cover being movable into and between a closed position retaining the ladder in the storage pocket and an open position facilitating removal of the ladder from the storage pocket. The cover may be pivotable into and between the open position and the closed position.

In non-limiting examples, the ladder comprises a plurality of rungs and a frame which is movable into and between an extended position facilitating use and a collapsed position facilitating storage in the storage pocket.

In non-limiting examples, the retaining mechanism comprises a pair of cleats which are spaced apart and together with the key and keyhole aperture retains the ladder in the storage pocket. The pair of cleats extend over a lower end of the storage pocket such that a retaining tray is defined in the pocket between the pair of cleats and the inside surface of the dive door.

In non-limiting examples, the ladder is removable from the storage pocket by vertically lifting the ladder within the storage pocket so as to disengage the key and keyhole aperture and by horizontally removing the ladder from the storage pocket. The pair of cleats may define a middle space through which a portion of the ladder passes as the ladder is removed from the storage pocket.

BRIEF DESCRIPTION OF THE DRAWINGS

The present disclosure includes the following Figures.

DETAILED DESCRIPTION

In the present disclosure, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

Figure 1:
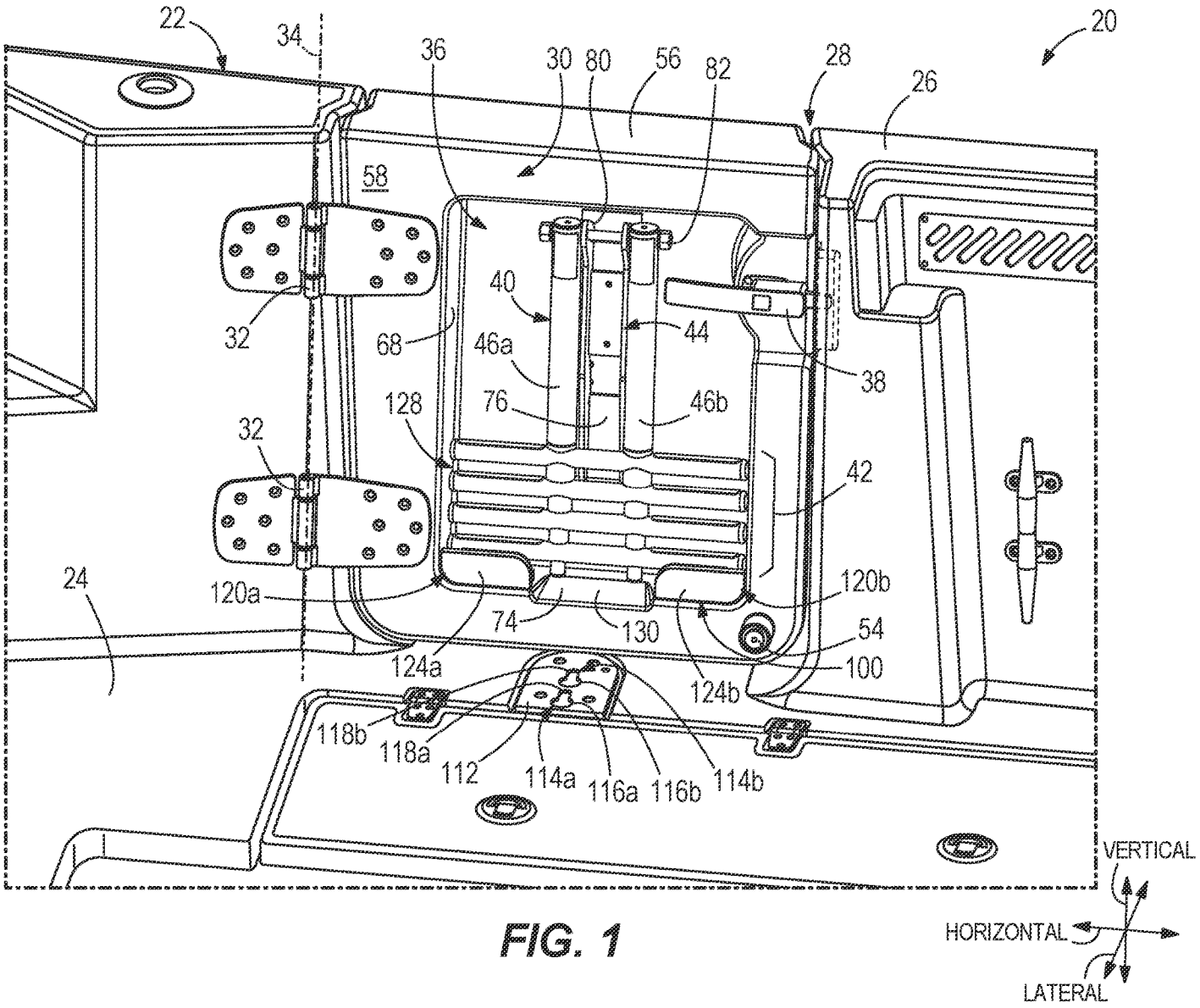
FIG. 1 is a perspective view of a marine vessel having a dive door which stores a ladder.

FIG. 1 shows a portion of a marine vessel 20 which includes a hull 22 having a deck 24 and a sidewall 26 extending vertically upwardly relative to the deck 24, together defining an interior of the marine vessel 20. The sidewall 26 includes a doorway 28 and a dive door 30, which is pivotably attached to the sidewall 26 and pivotable into and between an open position (FIG. 5) and a closed position (FIG. 1), such that in the closed position the dive door 30 is positioned within the doorway 28 and aligns with the sidewall 26.

The present inventors recognized a need for improved storage of accessories necessary for boating and related activities. Typically, marine vessels having removable swimming ladders do not have designated storage spaces for the ladders, and/or designated ladder retaining mechanisms are placed in shared storage spaces, which can be both a snagging hazard and may be visually unappealing. The present inventors have realized a desirability of creating a dedicated storage pocket in the dive door, ensuring that necessary equipment is near where swimming activity takes place and without negatively impacting storage in the rest of the boat. In addition, the inventors recognized a desirability for a variety of retaining mechanisms, optionally including a covering face which opens to reveal the dive ladder and helps to alleviate problems of snagging dock lines or clothing, as well as makes the storage solution visually appealing.

Referring to FIGS. 1-4, the novel dive door 30 extends from the deck 24 to an upper face 56 in a vertical direction, from left to right in a horizontal direction, and from an interior face 58 to a hull face 60 (shown in FIGS. 3-4) in a lateral direction. The dive door 30 is attached to the sidewall 26 via at least one hinge 32 and is pivotable about a vertical axis 34 into the interior of the vessel 20. The dive door 30 includes a rectangular storage pocket 36 and a retaining mechanism 100 which facilitates storage in and removal of a ladder 40 from the storage pocket 36. The type and configuration of the ladder 40 can vary from what is shown. The illustrated embodiments depict a ladder which is available for purchase from Gaerlick, part number 19626-92. As will be evident from the embodiments described herein below the type and configuration of the retaining mechanism 100 can vary. The dive door 30 further includes a handle 38 which is positioned on the opposing side of the door 30 from the hinge 32. The handle 38 engages and disengages the dive door 30 from the sidewall 26 such that the dive door 30 can be moved between the open position and the closed position. In some embodiments, the dive door 30 further comprises a rubber stopper 54 on the interior face 58 for preventing damage to the sidewall 26 and for securing the dive door 30 in the open position.

Figure 2:
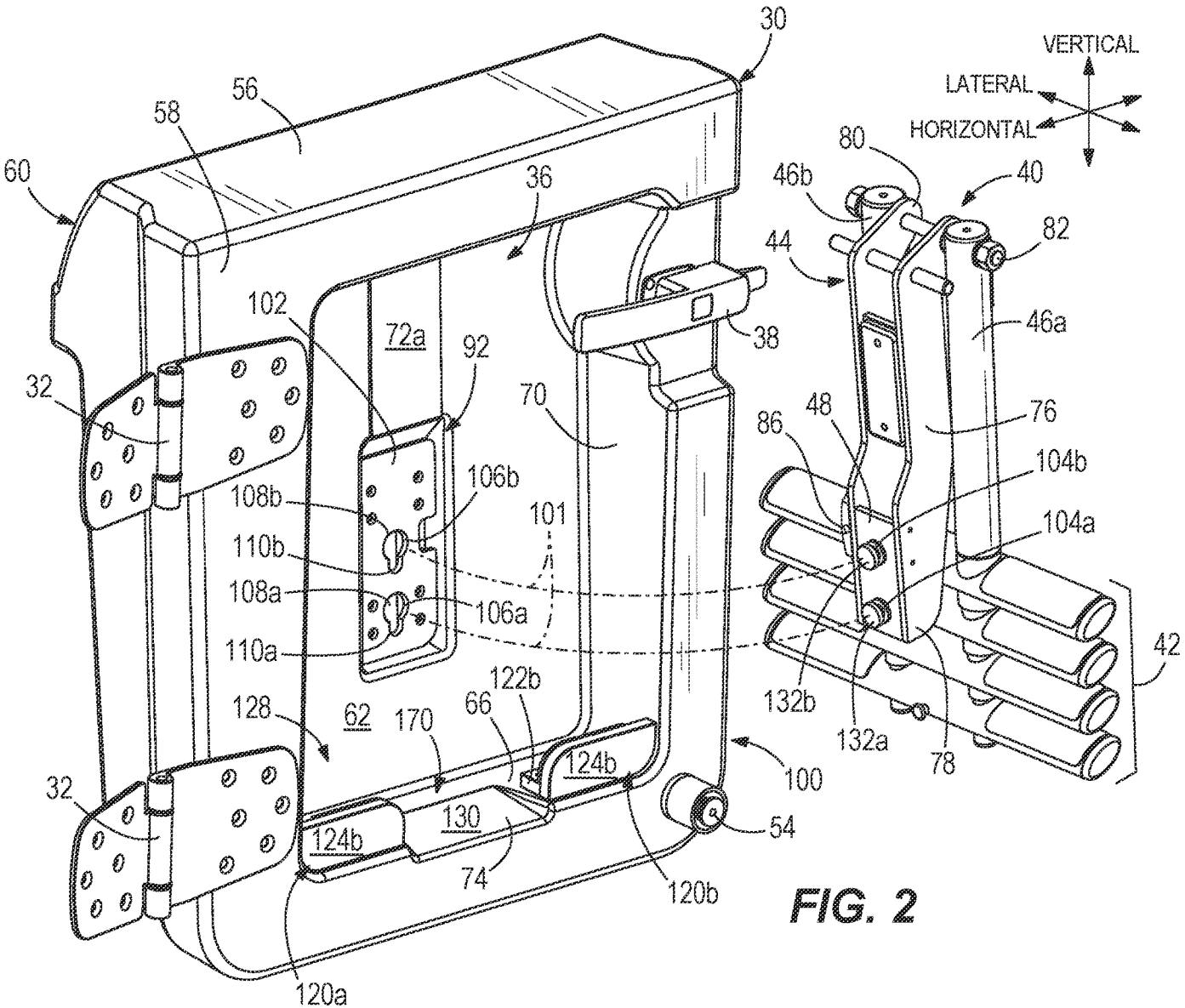
FIG. 2 is a perspective view of a first embodiment of a retaining mechanism for removal of the ladder from the dive door.
Figure 3:
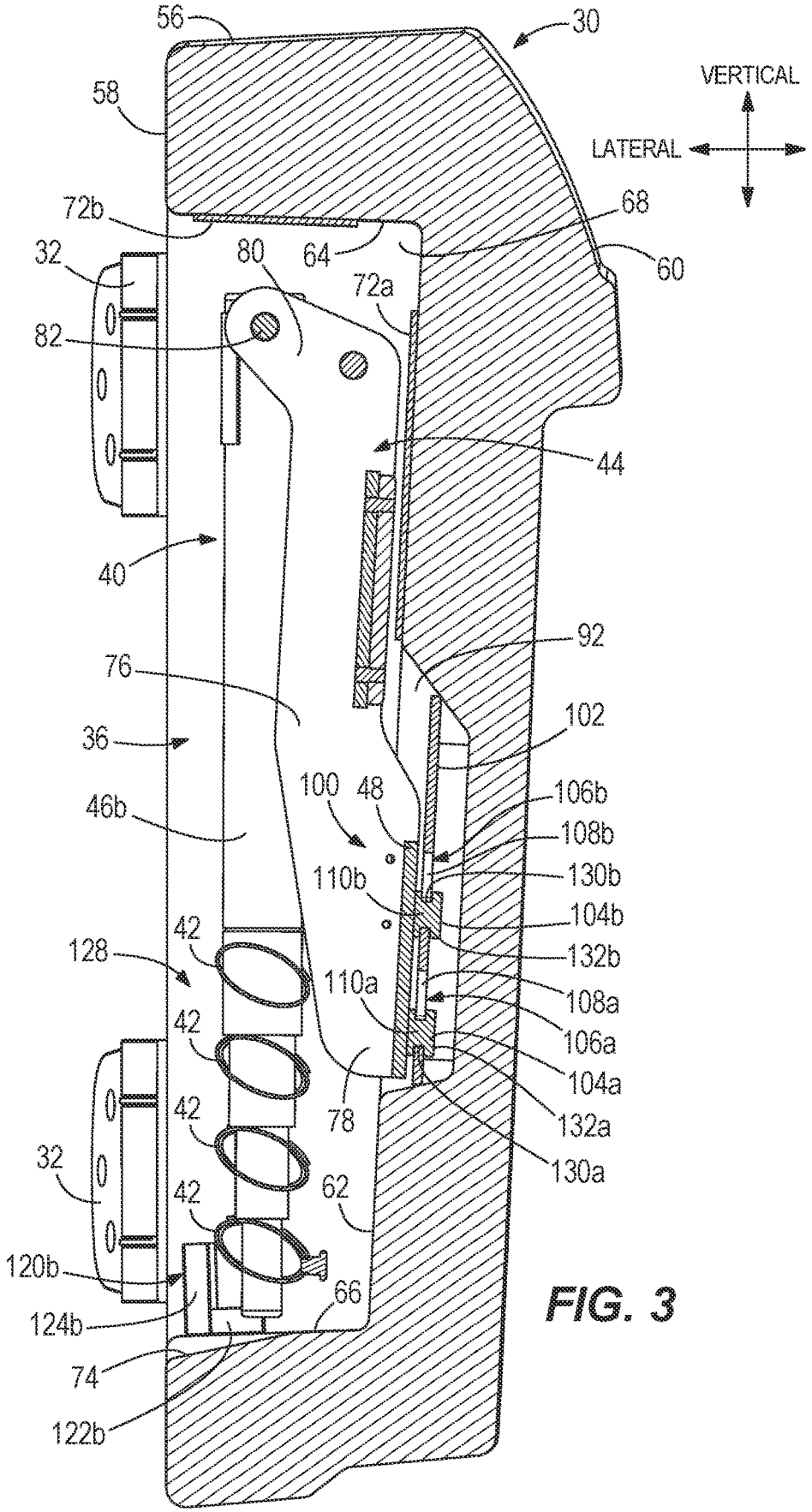
FIG. 3 is a sectional view of the dive door and retaining mechanism retaining the ladder according to the first embodiment.
Figure 4:
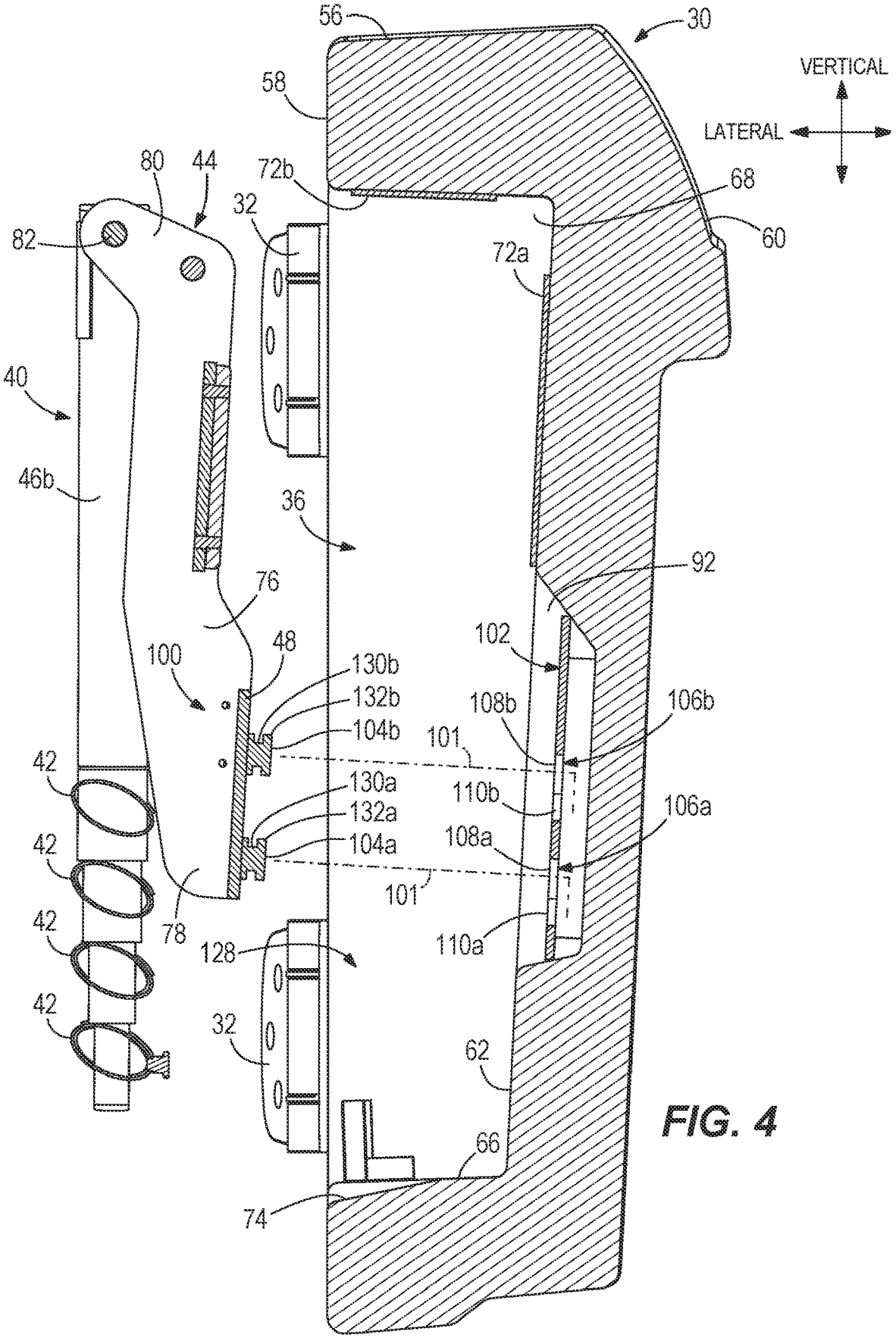
FIG. 4 is a sectional view of the dive door and retaining mechanism, showing removal of the ladder according to the first embodiment.

As best shown in FIGS. 2-4, the storage pocket 36 extends into the dive door 30 laterally toward the hull face 60. The rectangular storage pocket 36 has an inner face 62, an upper face 64 and a lower face 66 which define a vertical height of the inner face 62, and a left face 68 and a right face 70 which define a horizontal width of the inner face 62. The dive door 30 has a rectangular inset cavity 92 for accommodating protruding portions of the ladder 40. The rectangular inset cavity 92 is recessed laterally into the inner face 62 toward the hull face 60 and positioned between the left face 68 and the right face 70 and between the upper face 64 and the lower face 66. As shown in FIGS. 3-4, positioned on the inner face 62 and the upper face 64 in between the left face 68 and the right face 70 are a first and a second rattle mitigation pad 72*a*, 72*b*, which are configured to prevent the ladder 40 from damaging the dive door 30 and/or being damaged. Positioned on the lower face 66 is a drain 74, which slopes vertically downward toward the deck 24 to permit drainage of water from the storage pocket 36.

Figure 5:
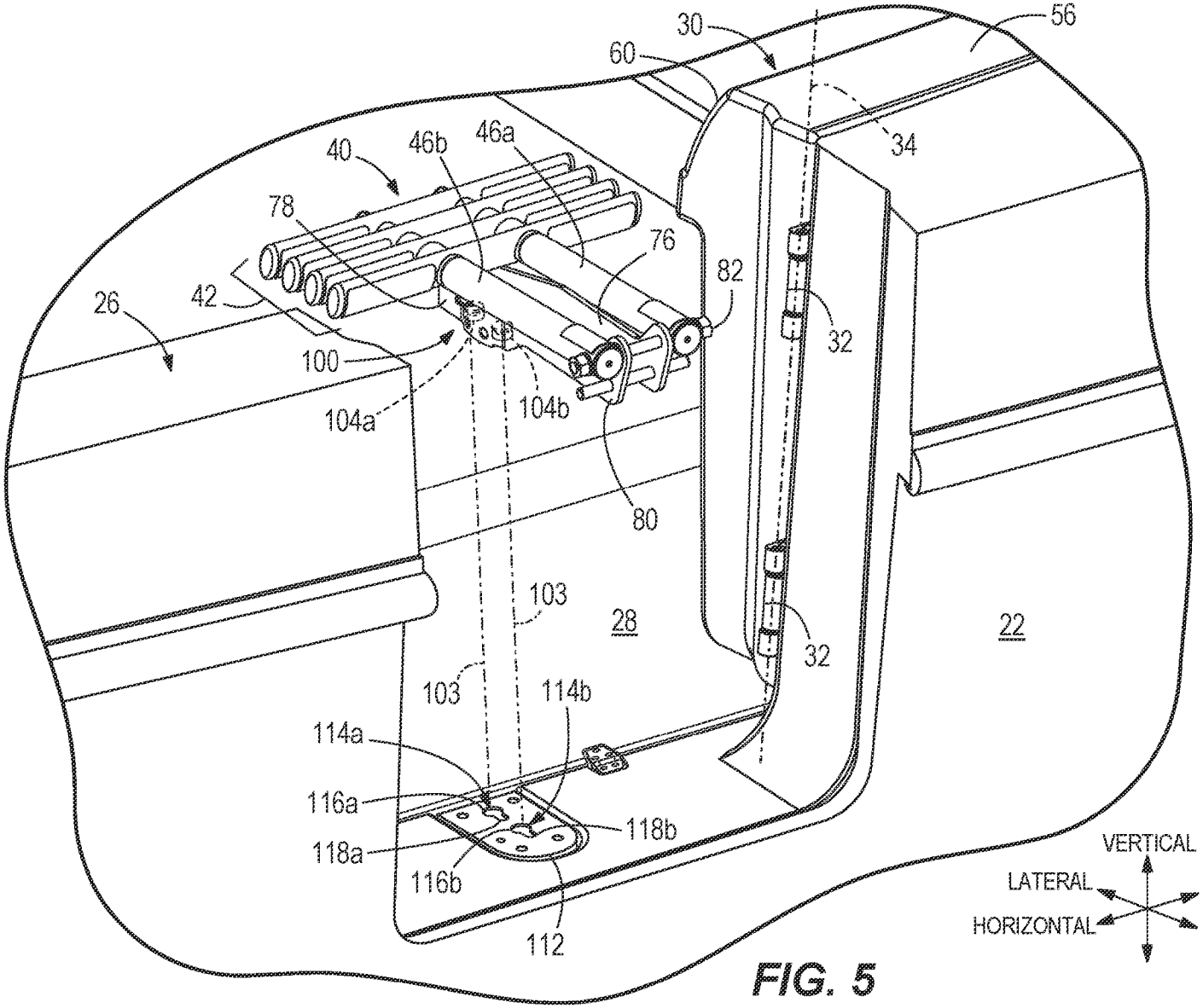
FIG. 5 is a perspective view demonstrating engagement of the ladder with a deck.
Figure 6:
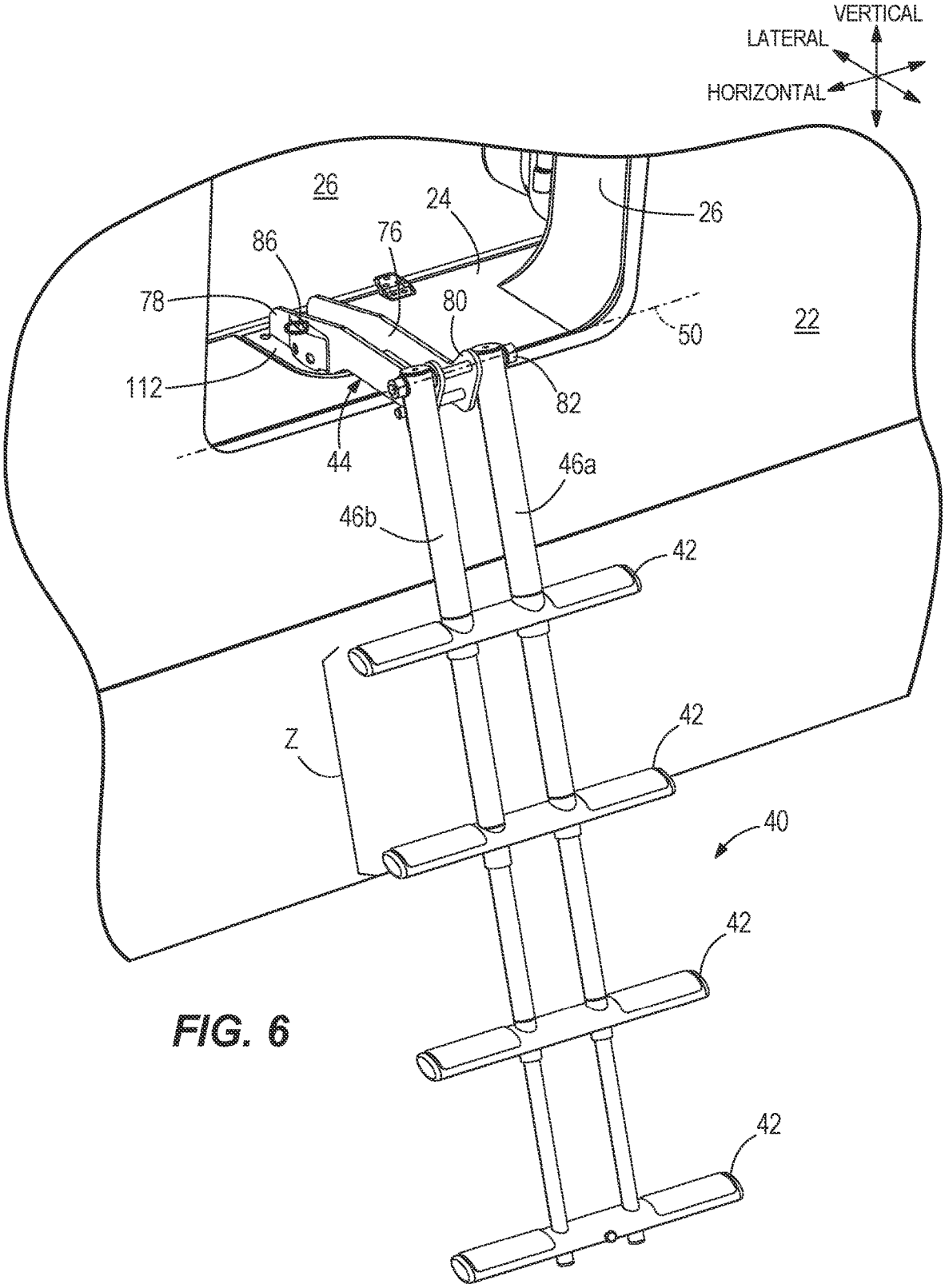
FIG. 6 is a perspective view of the ladder in an extended position.

Referring to FIG. 2, the ladder 40 includes four rungs 42 and a frame 44. The rungs 42 extend horizontally and are arranged in a stack vertically. The frame 44 includes a pivot bracket 76, a mounting plate 48, and a first and a second vertical rail 46*a*, 46*b* which perpendicularly transect and support the rungs 42. The pivot bracket 76 extends in a vertical direction between the first and the second vertical rail 46*a*, 46*b* and has a first end 78 and a second end 80. The pivot bracket 76 is fixedly coupled to the mounting plate 48 at the first end 78 and pivotably coupled to the first and the second vertical rails 46*a*, 46*b* on opposing sides of the second end 80 via a pivot joint 82. Each of the vertical rails 46*a*, 46*b* are telescopic such that the ladder 40 is movable into and between a collapsed position (FIG. 5) and an extended position (FIG. 6). In some embodiments, the frame 44 further includes a spring-loaded pin 86 which engages with the mounting plate 48 on the deck 24 when the ladder 40 is in the extended position.

In the collapsed position, each of the vertical rails 46*a*, 46*b* are fully collapsed such that the rungs 42 abut one another and the pivot bracket 76 and the first and the second vertical rail 46*a*, 46*b* are folded such that the pivot bracket 76 is nested within the space between the first and the second vertical rail 46*a*, 46*b*. In the extended position, each of the vertical rails 46*a*, 46*b* is telescopically extended such that the rungs 42 are separated by a distance Z. Further, the first and the second vertical rails 46*a*, 46*b* are pivoted about a horizontal axis 50 via the pivot joint 82 on the pivot bracket 76 such that the mounting plate 48 can be engaged with the deck 24. As shown in FIG. 6, the mounting plate 48 is engaged with the deck 24 within the doorway 28, such that the ladder 40 in the extended position is positioned within the body of water.

The ladder 40 is configured to be collapsed in order to be stored within the storage pocket 36 when not in use. To retain the ladder 40 within the storage pocket 36, a novel retaining mechanism is provided according to one or more of the following embodiments.

In a first and exemplary embodiment, as shown in FIGS. 1-6, the retaining mechanism 100 includes a keyhole plate 102 and a first and a second key 104*a*, 104*b*. The keyhole plate 102 is positioned within the inset cavity 92 and includes a first and a second keyhole aperture 106*a*, 106*b* which are positioned in vertical alignment on the keyhole plate 102. The first and the second keyhole 106*a*, 106*b* each have a wide end 108*a*, 108*b* and a narrow end 110*a*, 110*b*. Each of the keyholes 106*a*, 106*b* are shaped so that the wide ends 108*a*, 108*b* are vertically above the narrow ends 110*a*, 110*b*. The first and the second key 104*a*, 104*b* are positioned on the mounting plate 48 and are spaced apart vertically in alignment with the first and second keyhole 106*a*, 106*b*, respectively, as shown in FIG. 2. The first and the second key 104*a*, 104*b* each have a narrow base 130*a*, 130*b* and an engaging head 132*a*, 132*b* which extends from the respective narrow base 130*a*, 130*b*. The first and the second narrow base 130*a*, 130*b* are sized to pass through the wide end 108*a*, 108*b* and the narrow end 110*a*, 110*b* of the respective keyhole 106*a*, 106*b*. The first and the second engaged head 132*a*, 132*b* are sized to pass through the wide end 108*a*, 108*b* of the respective keyhole 106*a*, 106*b* but to not pass through the respective narrow end 110*a*, 110*b*.

The deck 24 further includes a second keyhole plate 112, configured identically to the keyhole plate 102 and positioned within the doorway 28 such that a first and a second keyhole aperture 114*a*, 114*b* are aligned laterally. The first and the second keyhole 114*a*, 114*b* each have a wide end 116*a*, 116*b* and a narrow end 118*a*, 118*b*. Each of the keyholes 114*a*, 114*b* are shaped so that the narrow ends 118*a*, 118*b* are positioned closer to the doorway 28 than the wide ends 116*a*, 116*b* laterally.

In the exemplary embodiment, the dive door 30 further includes a first and a second ladder retaining cleat 120*a*, 120*b* which are positioned at the lower face 66 of the storage pocket 36 and on opposing sides of the drain 74. Each of the ladder retaining cleats 120*a*, 120*b* are L-shaped and have a rectangular base 122*a*, 122*b*, and a rectangular wall 124*a*, 124*b*. Each of the bases 122*a*, 122*b* extend laterally and horizontally and are secured to the lower face 66 of the storage pocket 36 on opposing sides of the drain 74. Each of the walls 124*a*, 124*b* extend vertically and horizontally over a lower end 128 the storage pocket 36 such that a retaining tray 170 is defined in the storage pocket 36 between the cleats 120*a*, 120*b* and the inner face 62. A middle space 130 is defined horizontally between the ladder retaining cleats 120*a*, 120*b* and extends vertically upward from the drain 74 to the upper face 64 of the storage pocket 36.

When not in use, the ladder 40 is configured to be retained in the collapsed position within the storage pocket 36 via the retaining mechanism 100. In the collapsed position, the mounting plate 48 faces laterally toward the inner face 62 of the storage pocket 36, and the rungs 42 face the interior of the vessel 20. To retain the ladder 40 within the pocket 36, as shown in FIGS. 1 and 3, the first and the second key 104*a*, 104*b* are engaged with the first and the second keyhole 106*a*, 106*b* at the wide end 108*a*, 108*b*, respectively, and lowered to engage with the narrow end 118*a*, 118*b*, as shown via the guidelines 101 in FIGS. 2 and 4. Furthermore, the first and the second ladder retaining cleats 120*a*, 120*b* abut at least one of the rungs 42 and bar the first and the second vertical rails 46*a*, 46*b* from telescopically extending out of the storage pocket 36.

To remove the ladder 40 from the storage pocket 36, as shown via the guidelines 101 in FIGS. 2 and 4, the ladder 40 is vertically lifted to disengage the first and second key 104*a*, 104*b* from the first and the second keyhole 106*a*, 106*b* and laterally pulled toward the interior of the marine vessel 20 such that the engaging head 132*a*, 132*b* of the respective key 104*a*, 104*b* passes through the wide end 108*a*, 108*b* of the respective keyhole 106*a*, 106*b*. The middle space 130 allows the vertical rails 46*a*, 46*b* of the ladder 40 to horizontally pass through the first and the second ladder retaining cleat 120*a*, 120*b* upon removal.

To move the ladder 40 into the extended position, the ladder 40 is engaged with the deck 24 via the mounting plate 48 and secured therein via the spring-loaded pin 86, as is conventional. The first and the second vertical rails 46*a*, 46*b* are then pivoted about the horizontal axis 50 via the pivot joint 82 and telescopically extended such that the rungs 42 are positioned within the body of water.

The mounting plate 48 is engaged with the second keyhole plate 112 of the deck 24 via the first and the second keys 104*a*, 104*b*. As shown in FIG. 5, the first and the second keys 104*a*, 104*b* are lowered into the first and the second keyhole aperture 114*a*, 114*b* as shown via guidelines 103. As described in reference to the first keyhole plate 102, the first and the second engaging head 132*a*, 132*b* are sized to pass through the wide end 116*a*, 116*b* of the respective keyhole 114*a*, 114*b* and to not pass through the respective narrow end 118*a*, 118*b*.

To engage the ladder 40 with the deck 24, the ladder 40 is lowered such that the first and the second engaging head 132*a*, 132*b* of the respective first and second key 106*a*, 106*b* pass through the first and the second wide end 116*a*, 116*b* of the respective first and second keyhole aperture 114*a*, 114*b*. The ladder 40 is then pushed laterally away from the interior of the marine vessel 20 such that the first and second key 106*a*, 106*b* engage with the first and the second narrow end 118*a*, 118*b* of the respective keyhole 114*a*, 114*b*. To disengage the ladder 40 from the deck 24, the ladder 40 is pulled laterally inward toward the interior of the marine vessel 20 and moved upward along the guideline 103 in the opposite direction.

Figure 7:
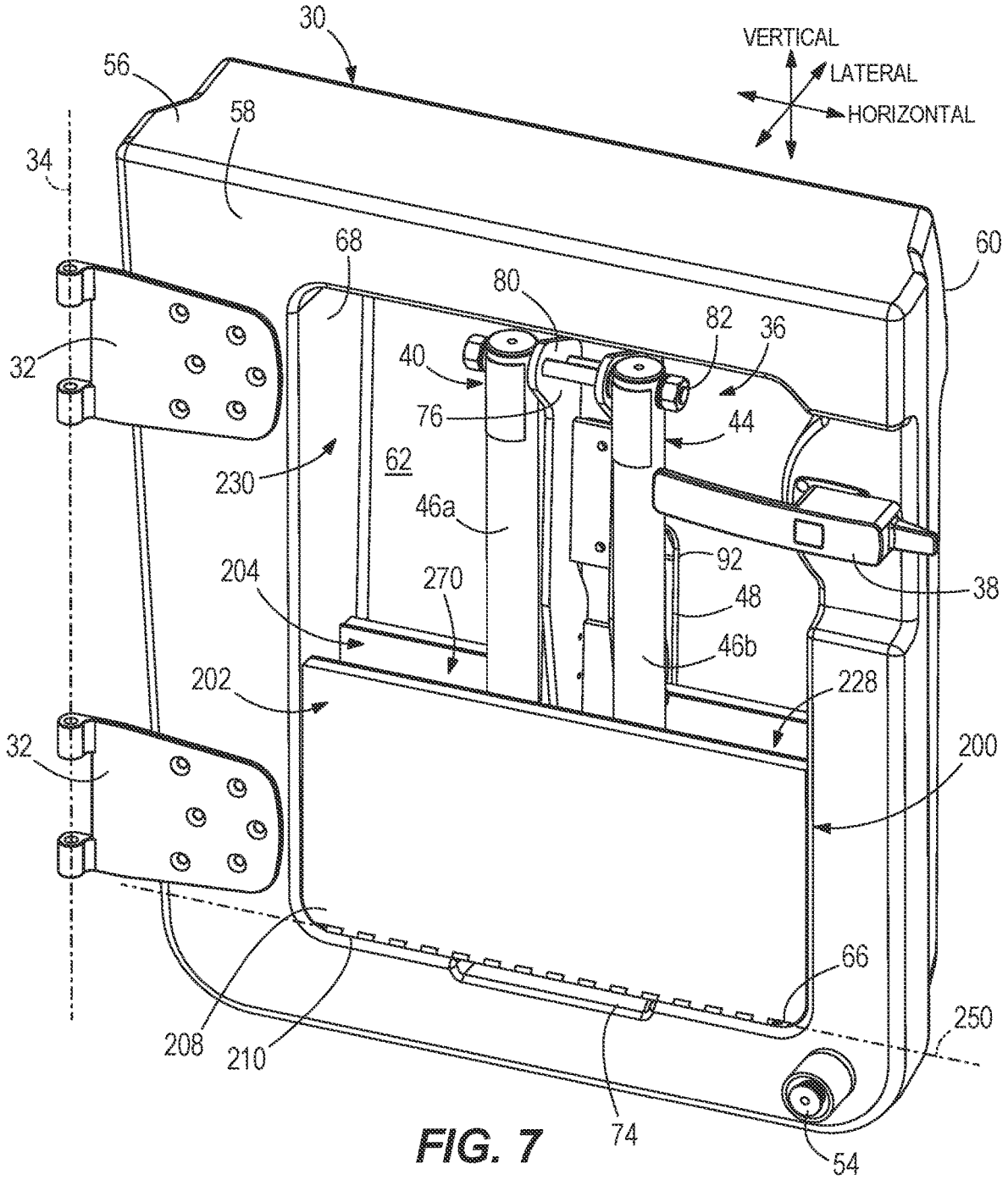
FIG. 7 is a perspective view of a second embodiment of a retaining mechanism for retaining the ladder within the dive door.
Figure 8:
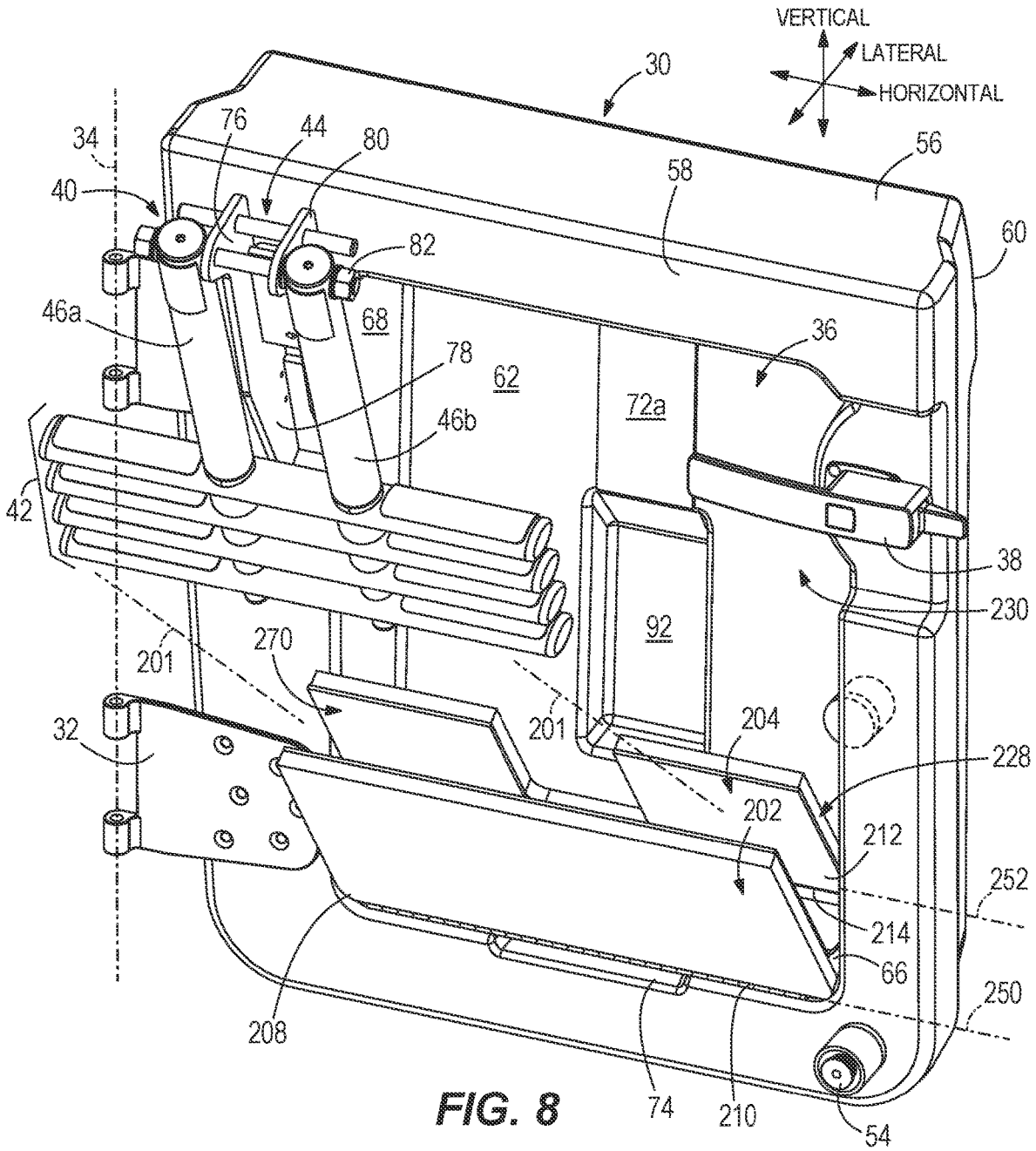
FIG. 8 is a perspective view of the second embodiment of the retaining mechanism, showing removal of the ladder from the dive door.

In a second embodiment, as shown in FIGS. 7-8, a retaining mechanism 200 includes an outer cover 202 which is pivotably coupled to the lower face 66 of the storage pocket 36 proximate the interior of the vessel 20. In the illustrated embodiment, the retaining mechanism 200 further includes an inner cover 204 which is pivotably coupled to the lower face 66 of the storage pocket 36 proximate the inner face 62.

The outer cover 202 and the inner cover 204 extend horizontally and span the entire horizontal length of the lower face 66 of the storage pocket 36. The outer cover 202 and inner cover 204 are pivotable into and between an open position (FIG. 8) and closed position (FIG. 7) to facilitate removal of the ladder 40 from the storage pocket 36. In the closed position, the outer cover 202 and the inner cover 204 extend vertically upward and over a lower end 228 of the storage pocket 36 such that a retaining tray 270 is defined in the storage pocket 36. The outer cover 202 has a lower end 208 which is coupled to the lower face 66 of the storage pocket 36 via a hinge 210 and configured to pivot about a horizontal axis 250. The inner cover 204 has a lower end 212 which is coupled to the lower face 66 of the storage pocket 36 via a hinge 214 and configured to pivot about a horizontal axis 252. The inner cover 204 has an upper end 206 which is shaped to circumvent the periphery of the inset cavity 92. In certain embodiments, the outer cover 202 is configured to be extendable vertically such that the outer cover 202 further extends over an upper end 230 of the storage pocket 36.

When not in use, the ladder 40 is configured to be retained in the collapsed position within the storage pocket 36 via the retaining mechanism 200. In the collapsed position, the mounting plate 48 faces laterally toward the inner face 62 of the storage pocket 36, and the rungs 42 face the interior of the vessel 20. The mounting plate 48 is nested within the inset cavity 92 and the outer cover 202 and inner cover 204 retain the ladder 40 within the storage pocket 36, as shown in FIG. 7.

To remove the ladder 40 from the storage pocket 36, as shown via the guidelines 201 in FIG. 8, the outer cover 202 and the inner cover 204 are pivoted into the open position about the respective horizontal axis 250, 252 toward the interior of the marine vessel 20 along with the ladder 40, which is then lifted out of the retaining tray 270 along the guidelines 201. To return the ladder 40 into the storage pocket 36, the outer cover 202 and the inner cover 204 are pivoted about the respective horizontal axis 250, 252 toward the interior of the marine vessel 20, the ladder 40 is inserted along the guidelines 201 into the retaining tray 270, and the outer cover 202 and the inner cover 204 are pivoted about the respective horizontal axis 250, into the closed position.

Figure 9:
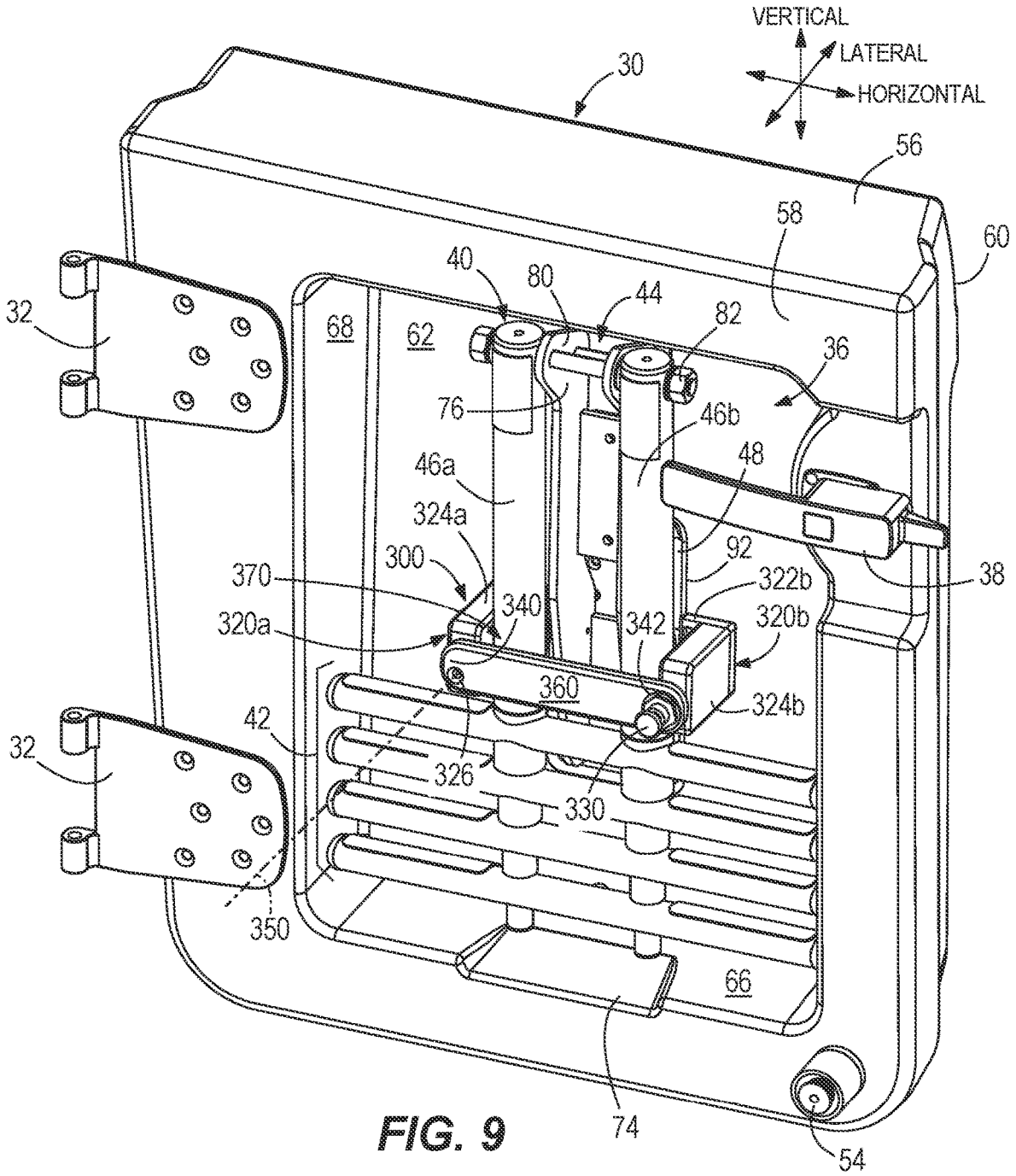
FIG. 9 is a perspective view of a third embodiment of a retaining mechanism for retaining the ladder within the dive door.
Figure 10:
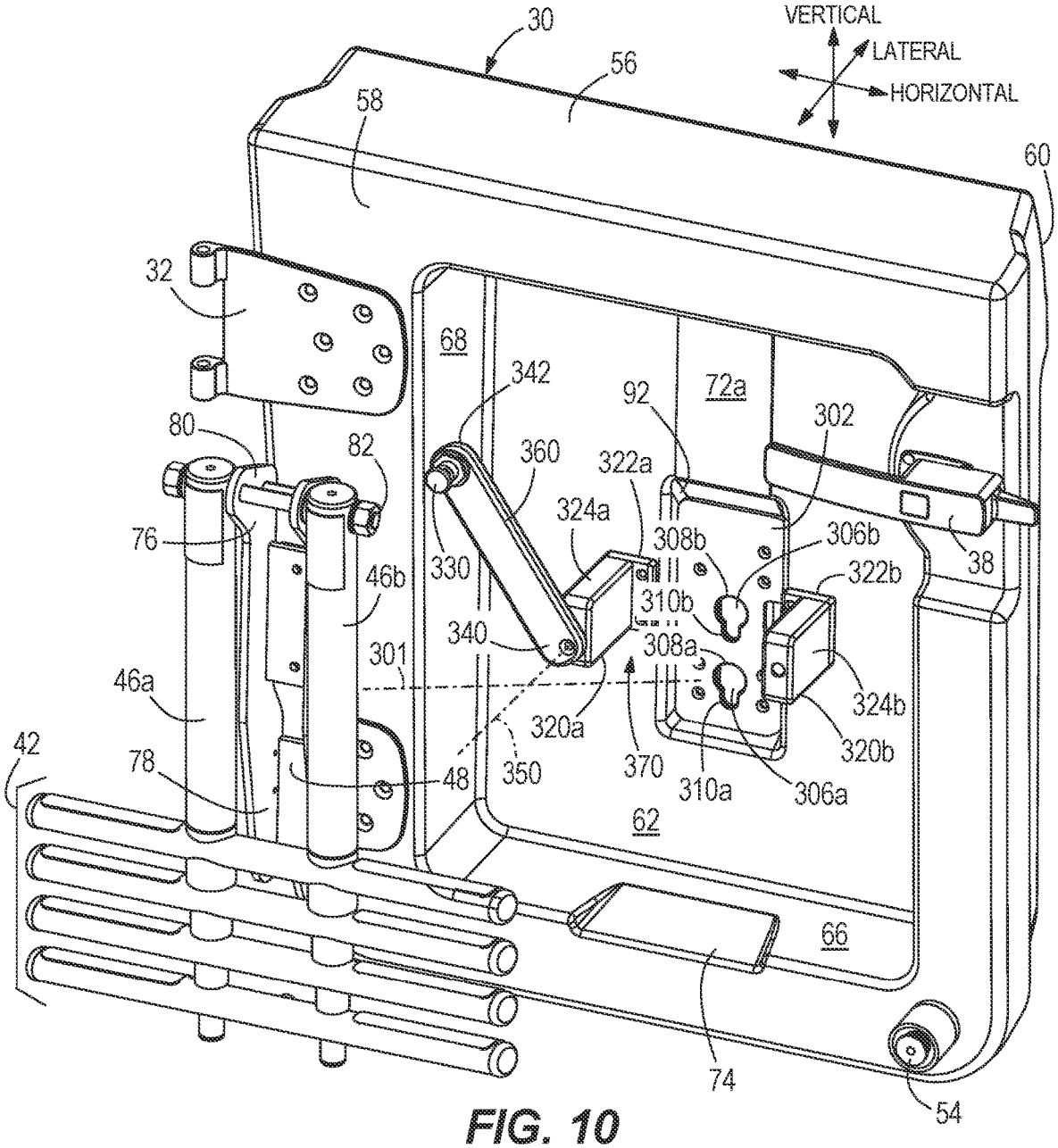
FIG. 10 is a perspective view of the third embodiment of the retaining mechanism, showing removal of the ladder from the dive door.

In a third embodiment, as shown in FIGS. 9-10, a retaining mechanism 300 includes a first and a second ladder retaining cleat 320*a*, 320*b* positioned on opposing sides of the inset cavity 92. Each of the ladder retaining cleats 320*a*, 320*b* are L-shaped and have a rectangular base 322*a*, 322*b*, and a rectangular wall 324*a*, 324*b*. Each of the bases 322*a*, 322*b* extend vertically and horizontally and are secured to the inner face 62 of the storage pocket 36 on opposing sides of the inset cavity 92. The first and the second wall 324*a*, 324*b* extend vertically and laterally from the horizontally outermost side of the first and the second base 322*a*, 322*b* to a first and a second top surface 332*a*, 332*b*, respectively.

The first cleat 320*a* further includes an arm 360. The arm 360 has a first end 340, a second end 342, and a spring-loaded pin 330. The first end 340 of the arm 360 is pivotably coupled to the wall 324*a* of the first ladder retaining cleat 320*a* via a pin 326 at the top surface 332*a*. The second end 342 of the arm 360 is removably coupled to the wall 324*b* of the second ladder retaining cleat 320*b* via the spring-loaded pin 330 at the top surface 332*b*. The arm 360 is pivotable about a lateral axis 350 via the pin 326. A retaining area 370 is defined in the storage pocket 36 between the first and the second ladder retaining cleats 320*a*, 320*b* and between the arm 360 and the inset cavity 92. The arm 360 is pivotable into and between an open position (FIG. 10) and a closed position (FIG. 9) to facilitate removal from and storage of the ladder 40 within the storage pocket 36.

The retaining mechanism 300 further includes a keyhole plate 302 and a first and a second key (not shown) which are configured in the same way as the first and the second keys 104*a*, 104*b* described in reference to the first embodiment. The keyhole plate 302 is positioned within the inset cavity 92 and includes a first and a second keyhole aperture 306*a*, 306*b*. The first and the second keyhole 306*a*, 306*b* each have a wide end 308*a*, 308*b* and a narrow end 310*a*, 310*b*. Each of the keyholes 306*a*, 306*b* are shaped so that the wide ends 308*a*, 308*b* are above the narrow ends 310*a*, 310*b* in the vertical direction. The first and the second key (not shown) are positioned on the mounting plate 48 and are spaced apart vertically in alignment with the first and second keyhole 306*a*, 306*b*, respectively, as shown in FIG. 10.

When not in use, the ladder 40 is configured to be retained in the collapsed position within the storage pocket 36 via the retaining mechanism 300. In the collapsed position, the mounting plate 48 faces laterally toward the inner face 62 of the storage pocket 36, and the rungs 42 face the interior of the vessel 20. To retain the ladder 40 within the pocket 36, as shown in FIG. 9, the first and the second key (not shown) are engaged with the first and the second keyhole 306*a*, 306*b* at the wide end 308*a*, 308*b*, respectively, and lowered to engage with the narrow end 318*a*, 318*b*. Furthermore, the arm 360 is pivoted about the lateral axis 350 into the closed position such that the arm 360 extends horizontally, closing the vertical rails 46*a*, 46*b* within the retaining area 370. The second end 342 of the arm 360 is coupled to the second ladder retaining cleat 320*b* via the spring loaded pin 330 at the top surface 332*b*.

To remove the ladder 40 from the storage pocket 36, as shown in FIG. 10 via guideline 301, the spring loaded pin 330 is released and the arm 360 is pivoted about the lateral axis 350 into the open position such that the arm 360 extends vertically. The ladder 40 is then vertically lifted to disengage the first and second key (not shown) from the first and the second keyhole 306*a*, 306*b* and laterally pulled toward the interior of the marine vessel 2 along the guideline 301.

Figure 11:
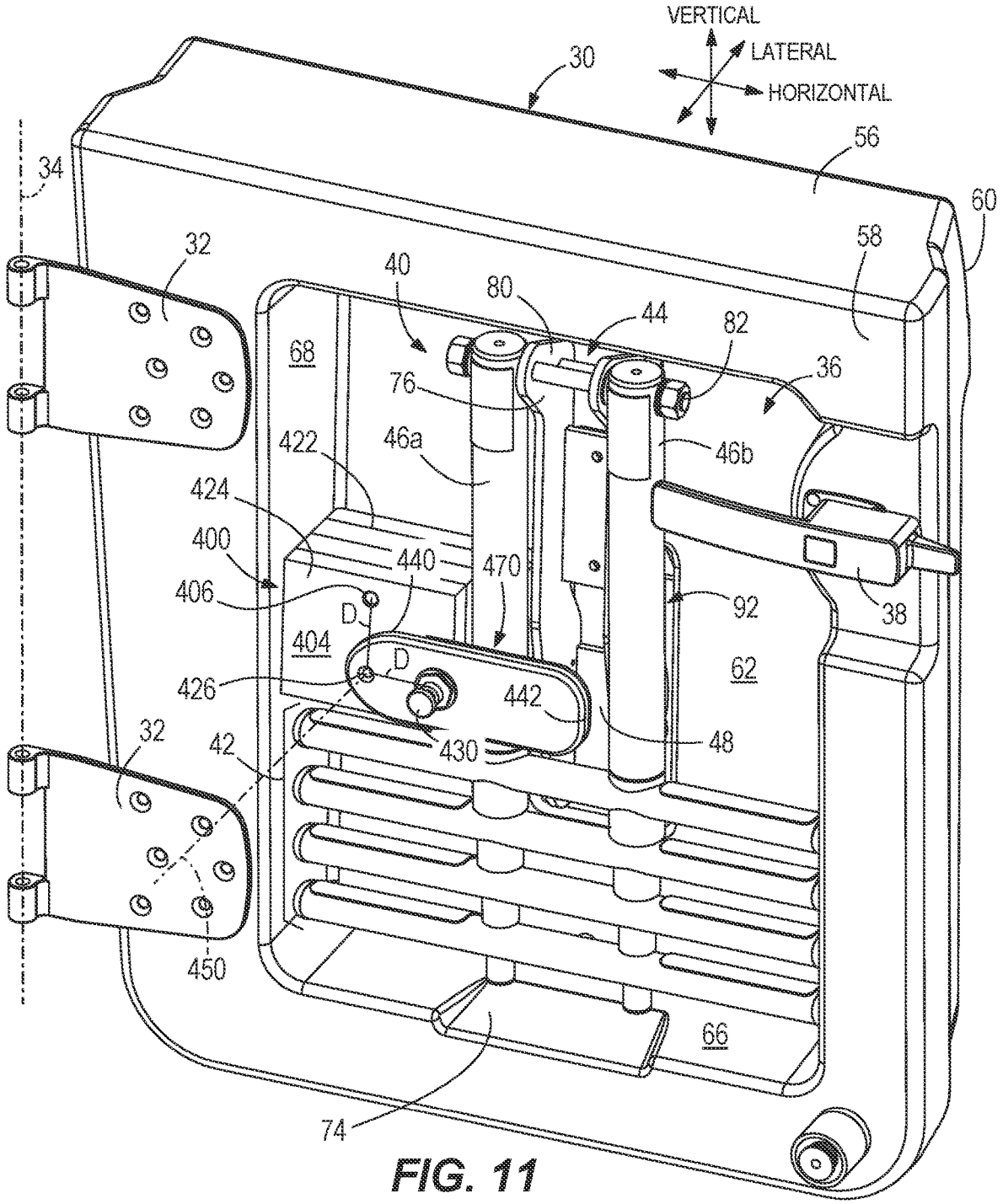
FIG. 11 is a perspective view of a fourth embodiment of a retaining mechanism for retaining the ladder within the dive door.
Figure 12:
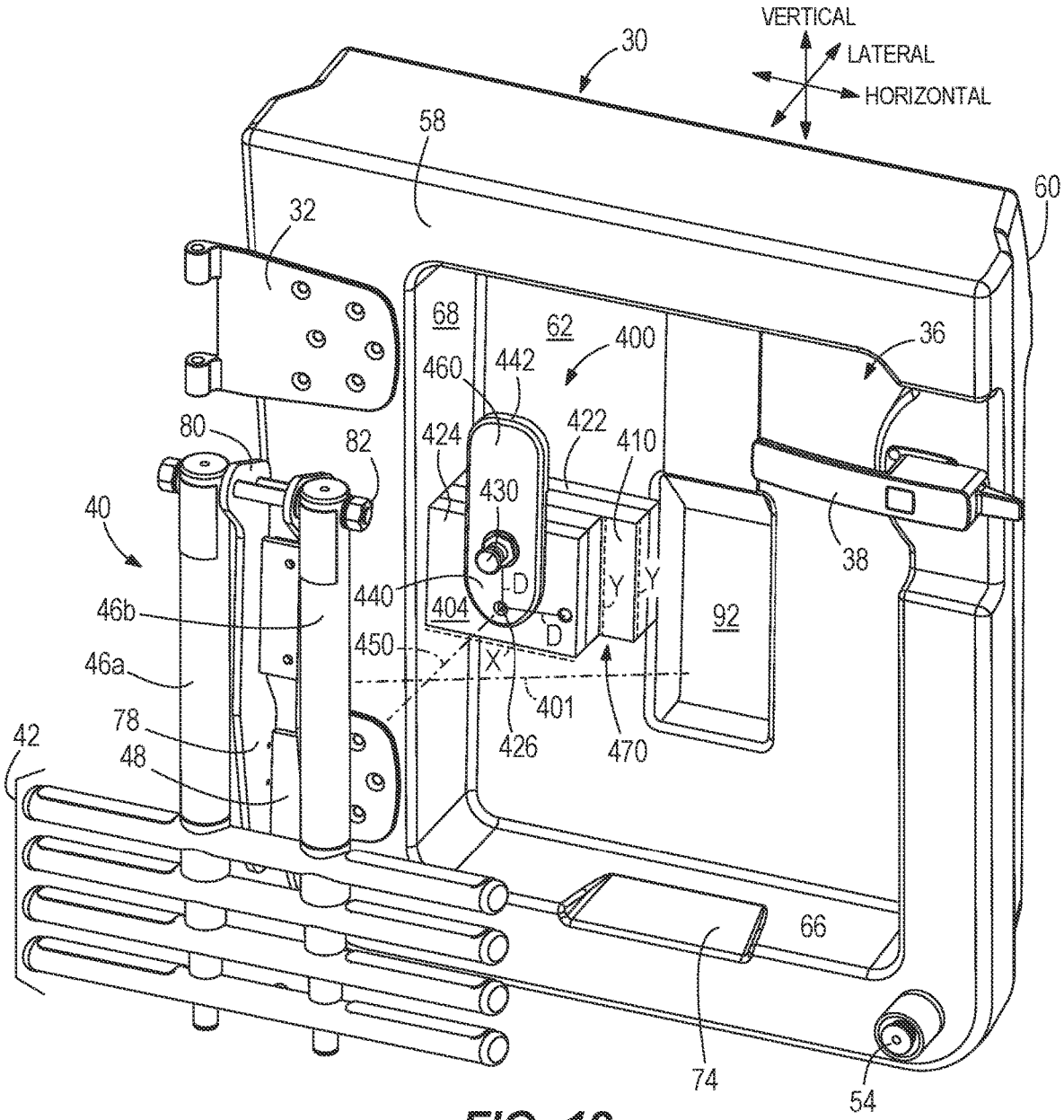
FIG. 12 is a perspective view of the fourth embodiment of the retaining mechanism, showing removal of the ladder from the dive door.

In a fourth embodiment, as shown in FIGS. 11-12, the retaining mechanism 400 includes a ladder retaining cleat 402 which has an arm 460. The ladder retaining cleat 402 is positioned adjacent the inset cavity 92 on either the left or right side. In the illustrated embodiment, the ladder retaining cleat 402 is positioned on the left side of the inset cavity 92.

The ladder retaining cleat 402 is L-shaped and has a rectangular base 422 and a rectangular wall 424. The base 422 has an inner face (not shown) which is secured to the inner face 62 of the storage cavity. The base 422 extends vertically a distance Y and horizontally from the left face 68 of the storage pocket 36 to the inset cavity 92. The base 422 extends laterally from the inner face (not shown) toward an outer face 410. The rectangular wall 424 has an inner face (not shown) which is secured to the outer face 410 of the base 422. The rectangular wall 424 extends vertically the distance Y and horizontally from the left face 68 of the storage pocket 36 to a distance X which is less than the distance from the left face 68 to the inset cavity 92. The rectangular wall 424 extends laterally from the inner face (not shown) toward an outer face 404.

The arm 460 has a first end 440, a second end 442, and a spring-loaded pin 430 located a distance D between the first end 440 and the second end 442. The ladder retaining arm 460 is pivotably coupled at the first end 440 to the outer face 404 via a pin 426. The ladder retaining arm 460 is pivotable about a lateral axis 450 into and between an open position (FIG. 12) and a closed position (FIG. 11). The outer face 404 of the ladder retaining cleat 402 further includes a first aperture 406 and a second aperture 408 configured to receive the spring-loaded pin 430. The first aperture 406 is positioned the distance D vertically above the pin 426. The second aperture 408 is positioned the distance D horizontally to the right of the pin 426. A retaining area 470 is defined in the storage pocket 36 by the outer face 410 of the base 422, the rectangular wall 424, and the arm 460.

When not in use, the ladder 40 is configured to be retained in the collapsed position within the storage pocket 36 via the retaining mechanism 400. In the collapsed position, the mounting plate 48 faces laterally toward the inner face 62 of the storage pocket 36, and the rungs 42 face the interior of the vessel 20. The mounting plate 48 is nested within the inset cavity 92 and the first vertical rail 46*a* abuts the outer face 410 of the base 422 of the ladder retaining cleat 402. To retain the ladder 40 within the pocket 36, as shown in FIG.

11, the arm 460 is pivoted about the lateral axis 450 into the closed position such that the arm 460 extends horizontally, abutting the first vertical rail 46*a* such that the first vertical rail 46*a* is held frictionally between the arm 460 and the base 422. The arm 460 is held horizontally in the closed position via the spring-loaded pin 430 which is engaged with the second aperture 408 on the outer face 404 of the rectangular wall 424.

To remove the ladder 40 from the storage pocket 36, as shown via guideline 401 in FIG. 12, the spring-loaded pin 430 is released and the arm 460 is pivoted about the lateral axis 450 into the open position such that the arm 460 extends vertically and the spring-loaded pin 430 is engaged with the first aperture 406 on the outer face 404 of the rectangular wall 424. The ladder 40 is then pulled toward the interior of the vessel 20 along the guideline 401.

Figure 13:
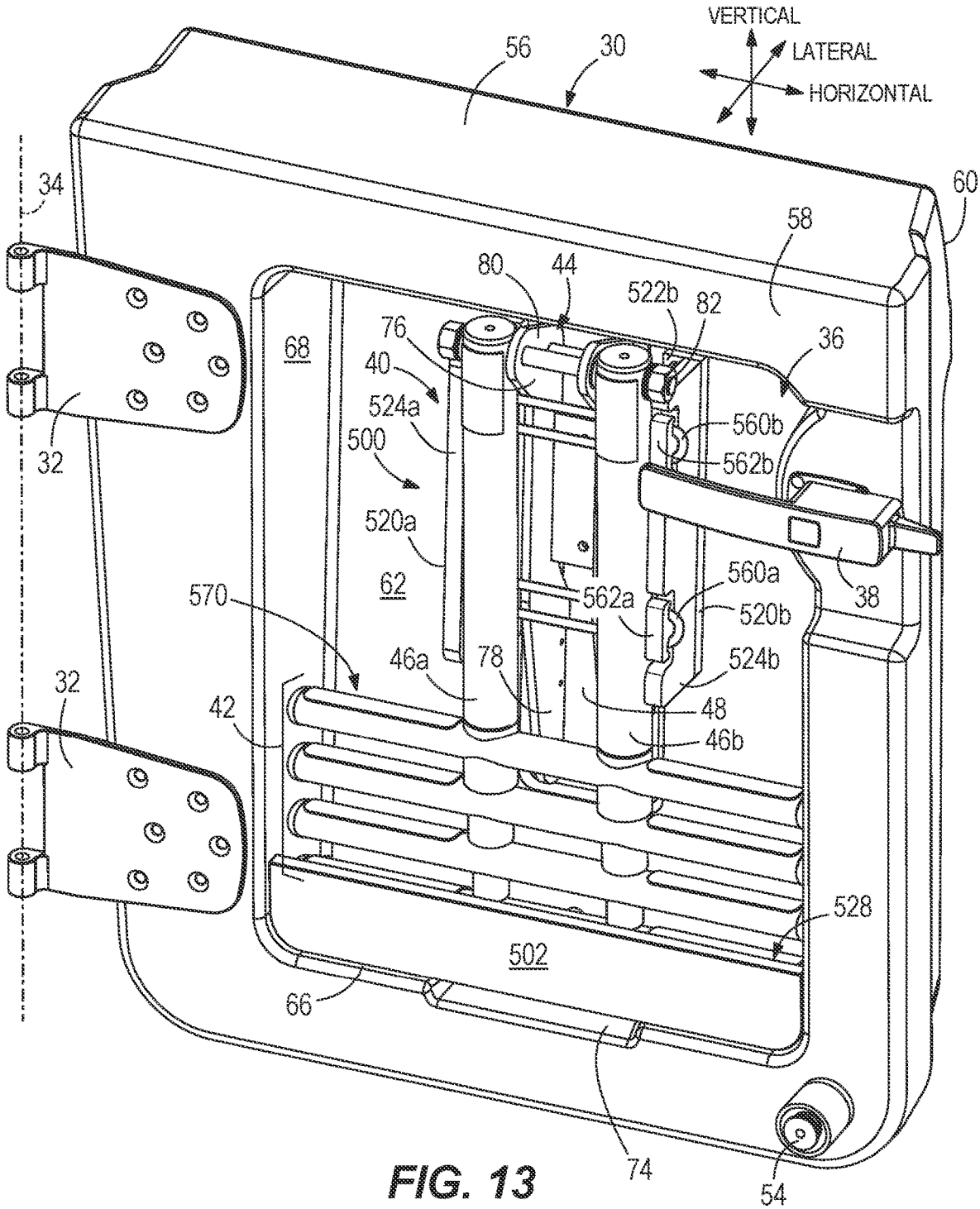
FIG. 13 is a perspective view of a fifth embodiment of a retaining mechanism for retaining the ladder within the dive door.
Figure 14:
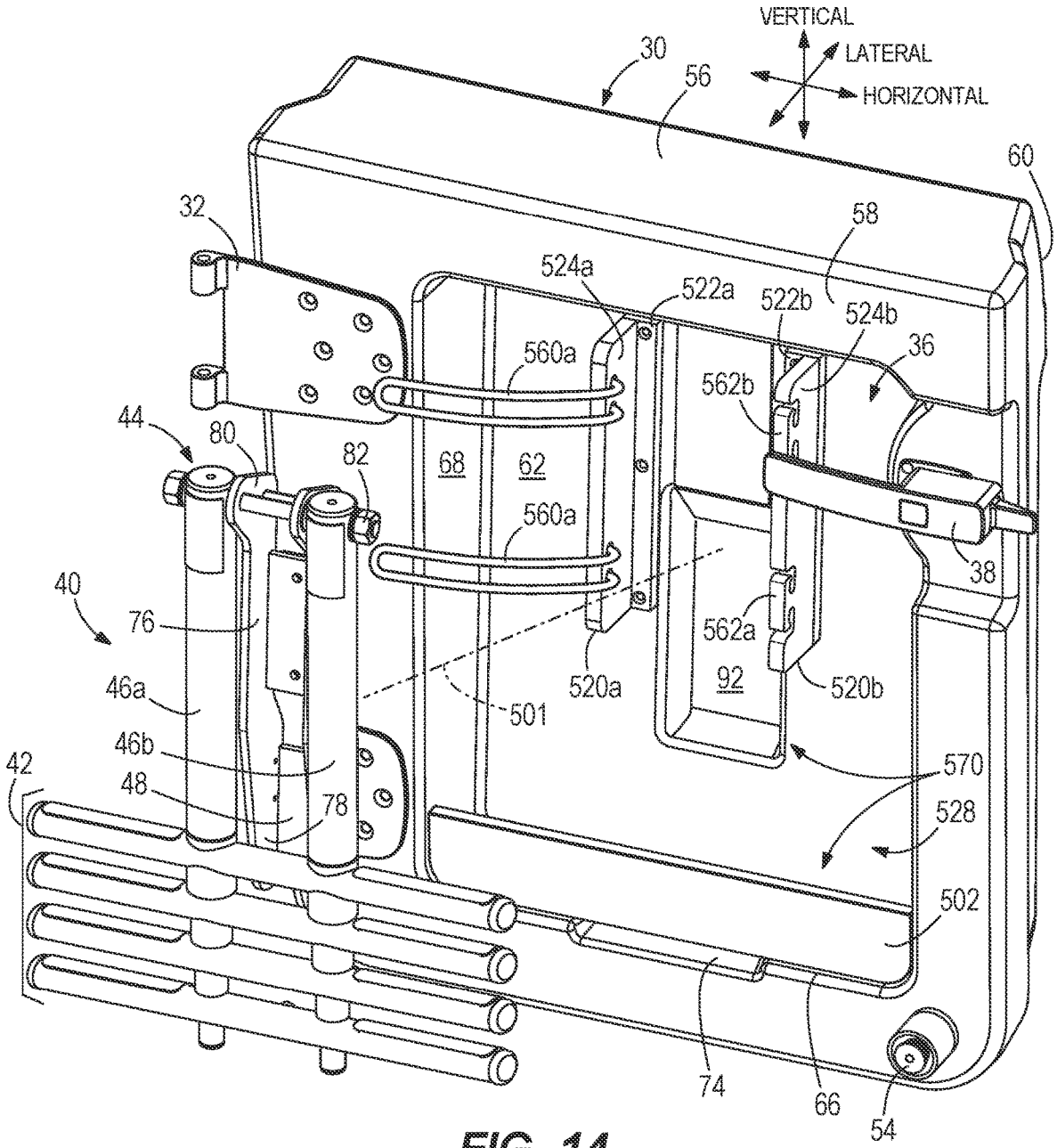
FIG. 14 is a perspective view of the fifth embodiment of the retaining mechanism, showing removal of the ladder from the dive door.

In a fifth embodiment, as shown in FIGS. 13-14, a retaining mechanism 500 includes a first and a second ladder retaining cleat 520*a*, 520*b* positioned on opposing sides of the inset cavity 92. Each of the ladder retaining cleats 520*a*, 520*b* are L-shaped and have a rectangular base 522*a*, 522*b*, and a rectangular wall 524*a*, 524*b*. Each of the bases 522*a*, 522*b* extend vertically and horizontally and are secured to the inner face 62 of the storage pocket 36 on opposing sides of the inset cavity 92. Each of the walls 524*a*, 524*b* extend vertically and laterally from the respective base 522*a*, 522*b* to a top end 532*a*, 532*b*. The first ladder retaining cleat 520*a* has a first and a second bungee cord 560*a*, 560*b* fixedly secured to the wall 524*a* and spaced apart in vertical alignment at the top end 532*a*. The second ladder retaining cleat 520*b* has a first and a second saddle-shaped cutout 562*a*, 562*b* spaced apart in vertical alignment at the top end 532*b*. The first and the second bungee cords 560*a*, 560*b* are positioned in alignment with the first and the second saddle-shaped cutouts 562*a*, 562*b* such that the first and the second bungee cord 560*a*, 560*b* can be extended and secured around the first and the second saddle-shaped cutout 562*a*, 562*b*, respectively.

The retaining mechanism 500 further includes a cover 502 which is coupled to the lower face 66 of the storage pocket 36 proximate the interior of the vessel 20. The outer cover 202 extends horizontally and spans the entire horizontal length of the lower face 66 of the storage pocket 36. The cover 502 extends vertically upward and over a lower end 528 of the storage pocket 36. A retaining area 570 is defined in the storage pocket 36 between the cover 502 and the inset cavity 92 and between the first and the second ladder retaining cleat 520*a*, 520*b*.

When not in use, the ladder 40 is configured to be retained in the collapsed position within the storage pocket 36 via the retaining mechanism 500. In the collapsed position, the mounting plate 48 faces laterally toward the inner face 62 of the storage pocket 36, and the rungs 42 face the interior of the vessel 20. The mounting plate 48 is nested within the inset cavity 92 and the rungs 42 face the interior of the vessel 20. To retain the ladder 40 within the pocket 36, as shown in FIG. 13, the first and the second bungee cord 560*a*, 560*b* are passed between the pivot bracket 76 and the vertical rails 46 and are secured around the first and the second saddle-shaped cutout 562*a*, 562*b*, respectively. Furthermore, the cover 502 abuts at least one of the rungs 42 and bars the first and the second vertical rails 46*a*, 46*b* from telescopically extending out of the storage pocket 36.

To remove the ladder 40 from the storage pocket 36, as shown via the guideline 501 in FIG. 14, the first and the second bungee cord 560*a*, 560*b* are removed from the first and the second saddle-shaped cutout 562*a*, 562*b*. The ladder 40 is then lifted vertically such that the first and the second vertical rail 46*a*, 46*b* clear the cover 502 and pulled toward the interior of the vessel 20 along the guideline 501.

What is claimed is:

1. A marine vessel for operating in a body of water, the marine vessel comprising:

a hull having a deck and a sidewall extending vertically upwardly relative to the deck, wherein together the sidewall and deck define an interior of the marine vessel, a dive door which is pivotable about a vertical pivot axis into and between an open position opening a doorway through which a swimmer can exit the interior of the marine vessel and a closed position closing the doorway, a storage pocket formed in an inside surface of the dive door facing the interior of the marine vessel, a retaining mechanism facilitating storage in and removal of a ladder from the storage pocket, the ladder for enabling a swimmer to climb into or out of the body of water via the doorway when the dive door is in the open position, and a drain which slopes downward toward the deck to permit drainage of water from the storage pocket.

2. The marine vessel according to claim 1, wherein the retaining mechanism comprises a key and keyhole aperture, wherein the key and keyhole aperture are engageable to retain the ladder in the storage pocket and disengageable to facilitate removal of the ladder from the storage pocket.

3. The marine vessel according to claim 2, wherein the keyhole aperture comprises a wide end and a narrow end, and wherein the retaining mechanism is engageable by inserting the key into the wide end and lowering the key into the narrow end, and further wherein the retaining mechanism is disengageable by raising the key into the wide end and removing the key from the wide end.

4. The marine vessel according to claim 1, wherein the retaining mechanism comprises a cleat which retains the ladder in the storage pocket.

5. The marine vessel according to claim 4, wherein the cleat is pivotable into and between a closed position retaining the ladder in the storage pocket and an open position facilitating removal of the ladder from the storage pocket.

6. The marine vessel according to claim 5, further comprising a spring-loaded pin which retains the cleat in the closed position and alternately in the open position.

7. The marine vessel according to claim 4, wherein the cleat extends over a lower end of the storage pocket such that a retaining tray is defined in the storage pocket between the cleat and the inside surface of the dive door.

8. The marine vessel according to claim 7, wherein the retaining mechanism further comprises a key and keyhole aperture which together with the cleat retains the ladder in the storage pocket, wherein the key and keyhole aperture are engageable to retain the ladder in the storage pocket and disengageable to facilitate manual removal of the ladder from the storage pocket.

9. The marine vessel according to claim 1, wherein the retaining mechanism further comprises a cover on the storage pocket, the cover being movable into and between a closed position retaining the ladder in the storage pocket and an open position facilitating removal of the ladder from the storage pocket.

10. The marine vessel according to claim 9, wherein the cover is pivotable into and between the open position and the closed position.

11. The marine vessel according to claim 1, wherein the retaining mechanism comprises a at least one bungee cord.

12. The marine vessel according to claim 1, wherein the ladder comprises a plurality of rungs and a frame which is movable into and between an extended position facilitating use and a collapsed position facilitating storage in the storage pocket.

13. The marine vessel according to claim 12, wherein the retaining mechanism further comprises a pair of cleats which are spaced apart and together with the key and keyhole aperture retains the ladder in the storage pocket.

14. The marine vessel according to claim 13, wherein the pair of cleats extends over a lower end of the storage pocket such that a retaining tray is defined in the storage pocket between the pair of cleats and the inside surface of the dive door.

15. The marine vessel according to claim 14, wherein the retaining mechanism further comprises a key and keyhole aperture which together with the pair of cleats retains the ladder in the storage pocket, wherein the key and keyhole aperture are engageable to retain the ladder in the storage pocket and disengageable to facilitate manual removal of the ladder from the storage pocket.

16. The marine vessel according to claim 15, wherein the ladder is removable from the storage pocket by vertically lifting the ladder within the storage pocket so as to disengage the key and keyhole aperture and by horizontally removing the ladder from the storage pocket.

17. The marine vessel according to claim 16, wherein the pair of cleats defines a middle space through which a portion of the ladder passes as the ladder is removed from the storage pocket.

18. The marine vessel according to claim 12, wherein the frame comprises a mounting plate and a pair of rails which support the plurality of rungs, and wherein the pair of rails are pivotable about a pivot joint relative to the mounting plate so move the ladder into and between the extended position and the collapsed position.

19. The marine vessel according to claim 18, wherein the pair of rails are telescopic to move the rungs in the plurality of rungs closer together in the collapsed position and alternately to move the rungs further apart in the extended position.

20. The marine vessel according to claim 19, wherein the ladder is engageable with the deck in the doorway of the marine vessel for enabling the swimmer climb into or out of the body of water via the doorway when the dive door is in the open position.

* * * * *